US008257718B2

(12) United States Patent
Mammone

(10) Patent No.: US 8,257,718 B2
(45) Date of Patent: Sep. 4, 2012

(54) APPARATUS AND METHOD FOR MANUFACTURE OF COSMETIC APPLICATOR

(76) Inventor: Rocco Mammone, Avondale Heights (AU)

( * ) Notice: Subject to any disclaimer, the term of this patent is extended or adjusted under 35 U.S.C. 154(b) by 1241 days.

(21) Appl. No.: 11/355,731

(22) Filed: Feb. 16, 2006

(65) Prior Publication Data

US 2006/0233847 A1 Oct. 19, 2006

Related U.S. Application Data

(63) Continuation-in-part of application No. 10/332,169, filed as application No. PCT/AU01/00807 on Jul. 5, 2001.

(60) Provisional application No. 60/251,176, filed on Dec. 4, 2000.

(30) Foreign Application Priority Data

May 9, 2005 (AU) ..... 2005201924

(51) Int. Cl.
*A61K 8/02* (2006.01)
*A61K 9/28* (2006.01)

(52) U.S. Cl. ..... 424/401; 427/2.14

(58) Field of Classification Search ..... 424/401; 427/2.14

See application file for complete search history.

(56) References Cited

U.S. PATENT DOCUMENTS

| | | | | |
|---|---|---|---|---|
| 3,667,676 | A * | 6/1972 | Watanabe et al. | 239/700 |
| 3,870,375 | A * | 3/1975 | Duncan et al. | 406/127 |
| 5,093,110 | A * | 3/1992 | Kamen et al. | 424/63 |
| 5,137,040 | A * | 8/1992 | Iosilevich et al. | 132/320 |
| 5,941,254 | A * | 8/1999 | Heler | 132/297 |
| 5,968,633 | A * | 10/1999 | Hamilton et al. | 428/174 |
| 6,283,664 | B1 * | 9/2001 | Gueret | 401/261 |

* cited by examiner

*Primary Examiner* — Brandon Fetterolf
*Assistant Examiner* — Shirley V Gembeh
(74) *Attorney, Agent, or Firm* — Garcia-Zamor IP Law; Ruy M. Garcia-Zamor

(57) ABSTRACT

A method of manufacturing a plurality of cosmetic applicators including providing an electrostatic control means for dissipating electrostatic charge or localizing electrostatic charge wherein the powder at least in part is retained on the cosmetic applicator surface with the assistance of electrostatic attraction between said surface and said cosmetics preparation.

10 Claims, 9 Drawing Sheets

POWDER APPLICATION AND RECOVERY SYSTEM

APPARATUS AND METHOD FOR MANUFACTURE OF COSMETIC APPLICATOR

FIELD OF THE INVENTION

The invention relates to an apparatus and method for manufacture of cosmetics, and relates particularly, but not exclusively, to an apparatus for manufacture of cosmetic applicator and improvements in the method of manufacture of cosmetic applicators.

BACKGROUND OF THE INVENTION

Cosmetics preparations of various types have been in use for many years. Accordingly, a wide range of application methods have been trialled, though primarily facial cosmetics are applied using a pencil, brush or stick, or other similar means.

This approach has been generally satisfactory. However, there are a number of problems associated with existing techniques of packaging and applying facial cosmetics. Among these problems is the difficulty some have in effectively applying cosmetics using conventional techniques. Also, some experience considerable difficulty in mastering the techniques required to successfully apply cosmetics preparations with sufficient competence to achieve the required effect.

Many individuals have particular difficulty with self application of eye-shadow. This is typically applied with mixing brushes and the challenge is to achieve even shading or colouring of each eye without smudging and to make up both eyes without noticeable differences. This aspect of distinct separated zones that need to be matched does not arise with most other areas of cosmetics application.

Current methods of applying eye shadow can take up to 10 to 15 minutes for self application, and even then, for the reasons just mentioned, the result can be less than perfect, leaving the user doubtful about feeling confident about her eye make-up through the day. This combination of the time required, the difficulty involved, and uncertain results, including worrying about smudging, colour outcome, messiness and an amateurish appearance, has led many women to avoid using eye make-up altogether.

The present applicant in its co-pending international application PCT AU/01/00807 which has been published as WO 02/01982 has devised a cosmetics applicator which includes a material surface and a cosmetic preparation provided on the surface. In one aspect, the cosmetics preparation is retained on the surface at least in part with the assistance of electrostatic attraction between the surface and the cosmetics preparation. In another aspect, a waxy or oily underlay is provided between the surface and the cosmetics preparation, and the material of the surface is selected to facilitate retention of the cosmetics preparation and the underlay while allowing a major proportion of the cosmetics preparation retained thereon to be transferred to a human skin surface in a single wiping pass of the cosmetics preparation across the skin surface.

Due to this new type of applicator it is important to create a new means of manufacture. It is, accordingly, an object of the present invention to attempt to address this aim relating to manufacture of cosmetics application.

SUMMARY OF THE INVENTION

The inventive concept of the applicator resides in a recognition that cosmetics preparations are advantageously provided by retaining a suitable amount of a cosmetics preparation on a suitable surface, so that the surface can be used to conveniently apply the cosmetics preparation to an appropriate part of the face. It is therefore imperative to provide a means of applying the cosmetics preparation onto the substrate and in the required pattern.

In accordance with the invention there is provided a method of manufacturing a plurality of cosmetic applicators each of which includes a material surface and a cosmetics preparation provided on said surface; the method including the steps of: providing a bulk powder storage vessel, providing an applicator having at least one powder applicator head for blowing powder in a controlled manner; providing a feed means from the bulk powder storage vessel to the applicator for providing powder to the applicator; providing a transport means for transporting a material relative to the powder applicator head to enable application of the powder in a controlled manner onto the material surface wherein said cosmetics preparation is retained on said surface.

The method of manufacturing a plurality of cosmetic applicators can include providing an electrostatic control means for dissipating electrostatic charge or localising electrostatic charge wherein the powder at least in part is retained on the cosmetic applicator surface with the assistance of electrostatic attraction between said surface and said cosmetics preparation. The electrostatic control means can have a ring structure attached to the applicator head.

The at least one powder applicator head can have a slit opening for simultaneous controlled spraying of a line of cosmetic applicators.

The at least one powder applicator head can use a venturi system to receive powder from the bulk powder storage vessel into a controlled air flow for applying the powder onto the cosmetic applicator surface material.

The method of manufacturing a plurality of cosmetic applicators can include providing a powder recovery means comprising a shroud having a first opening for receiving the powder applicator head and a second larger opening enabling substantially close overfitting over the material surface to which the powder is to be applied, the shroud including a third opening for connection to a vacuum system for substantial recovery of unrequired material. The vacuum system can be connected to the bulk powder storage vessel enabling reuse of excess powder. The bulk powder storage vessel can include a filtering system for filtering and sifting powder entering the bulk powder storage vessel to ensure consistent granular sizing.

The method can provide a plurality of bulk powder storage vessels each able to include a different coloured powder and each connected to and able to feed to at least one powder applicator head for blowing powder in a controlled manner.

The transport means allows relative location of the material to enable application of the powder from the plurality of bulk powder storage vessels in a controlled manner onto the material surface. This can allow sequential application of the different coloured powders.

The method of manufacturing a plurality of cosmetic applicators can include an initial step of applying a moisturising solution to the cosmetic powder on the surface material of the cosmetic applicator wherein the moisturising solution allows bonding of various powders applied thereon.

The method can also include a final step of applying a protection solution to the cosmetic powder on the surface material of the cosmetic applicator wherein the protection solution is applied directly to the user's skin with the cosmetic powder thereon.

The method of manufacturing a plurality of cosmetic applicators has material of said surface of the cosmetic applicator selected to facilitate retention of said cosmetics preparation thereon at least in part by said electrostatic attraction while allowing a major proportion of the cosmetics preparation retained thereon to be transferred to a human skin surface in a single wiping pass of the cosmetics preparation across the skin surface.

Therefore the apparatus provides manufacture of a cosmetics applicator including a material surface and a cosmetics preparation provided on the surface. The cosmetics preparation is retained on, and can be initially attracted to, the surface at least in part with the assistance of electrostatic attraction between the surface and the cosmetics preparation. The material of the surface is preferably selected to facilitate retention of the cosmetics preparation thereon by said electrostatic attraction while allowing a major proportion of the cosmetics preparation retained thereon to be transferred to a human skin surface in a single wiping pass of the cosmetics preparation across the skin surface.

The invention also provides a means of manufacturing a cosmetics applicator including: a material surface, a cosmetics preparation provided on said surface, and a waxy or oily underlay between said surface and said cosmetics preparation, wherein the material of said surface is selected to facilitate retention of said cosmetics preparation and said underlay while allowing a major proportion of the cosmetics preparation retained thereon to be transferred to a human skin surface in a single wiping pass of the cosmetics preparation across the skin surface.

Advantageously, said waxy or oily underlay is cosmetic foundation. Preferably, the underlay transfers with said cosmetics preparation during said wiping pass to provide an outer protective coating therefor.

Advantageously, said material surface is provided on a planar sheet shaped to provide a first portion defining said surface and a second portion to be gripped between fingers or thumb and a finger, for executing said single wiping pass. The first portion can typically be larger than the second portion.

Preferably, said material is provided as a planar sheet. Preferably, the planar sheet of material is cut to an appropriate shape and size to allow said cosmetics applicator to be conveniently used as required.

The surface preferably has a relatively low coefficient of friction. For this purpose, the surface can be substantially formed of PTFE (poly-tetrafluoroethylene), otherwise known as Teflon@, or of a PTFE-containing composite.

Preferably, the aforesaid electrostatic attraction is achieved by the surface of the material being electrostatically charged.

The cosmetics preparation can be, eg, a granular, dust-like or powder-based substance such as, for example, as eyeshadow; or a creme, wax or other liquid based preparation such as, for example, lipstick, or foundation.

When the cosmetics preparation is a powder, it can be applied to the surface of the material using a spray directed towards the surface. Preferably, the spray of the cosmetics preparation is efficiently directed to the material by virtue of the electrostatic attraction between the surface and the cosmetics preparation.

Preferably, the surface is shaped and sized to allow convenient use of the cosmetics preparation. Preferably, the surface includes a covered region to which the cosmetics preparation is applied, and a clear region to which the cosmetics preparation is not applied. Advantageously, the cosmetics preparation includes different colours of the preparation in distinct areas of the surface to facilitate different colour effects when the cosmetics applicator is used.

The invention further provides a method of providing a cosmetics applicator, the method including: providing a material having a surface; and applying a cosmetics preparation to at least part of the surface; wherein the cosmetics preparation is attracted to and/or retained on the surface at least in part with the assistance of electrostatic attraction between the surface and the cosmetics preparation.

The cosmetics preparation can be applied to the surface by spraying.

Preferably, the method further includes applying on said surface, a stencil to confine the cosmetics preparation to one or more predetermined areas of the surface.

The invention still further provides a method of applying a cosmetics preparation to a skin surface from a cosmetics applicator as described hereafter, comprising transferring said cosmetics preparation from the applicator surface to the skin surface in a single wiping pass of the cosmetics preparation across the skin surface.

DESCRIPTION OF METHOD OF PERFORMING THE INVENTION

A cosmetics applicator 20 constructed by an embodiment of an apparatus and method for manufacture of cosmetic applicator of the invention will now be described with reference to the accompanying drawings.

Figure 1:
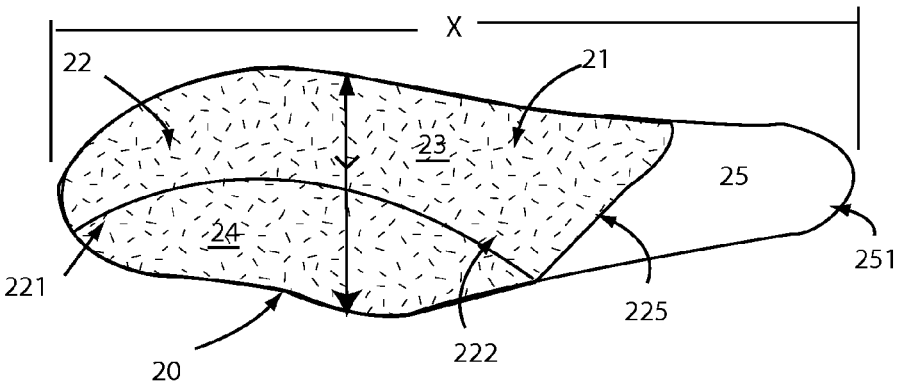
FIG. 1 is a diagrammatic representation of a cosmetics applicator especially suitable for retaining and applying eyeshadow to be manufactured by an apparatus and method for manufacture according to an embodiment of the invention.

The cosmetics applicator 20 to be constructed in one form by the production facility of the invention is illustrated on an enlarged scale with a magnification a little greater than 2, is represented in FIG. 1, and includes a surface 21 of a selected highly flexible PTFE containing material. The surface 21 can be considered as being divided into a relatively larger first portion 22 and a relatively smaller second portion 25. Larger portion 22 is covered with an underlay of a waxy or oily substance such as cosmetic foundation, overlaid with an outer layer of cosmetics preparation such as, for example, coloured make-up powder.

Relatively smaller second portion 25 is clear and uncovered. Portions 22, 25 meet at a boundary 27 marked by an edge of the powder layer and are defined at least in part by generally curved edges 25 of sheet 20.

The portion 22 can be divided at a boundary 222 into a first region 23 and a second region 24, which are respectively overlaid with different colours and/or types of cosmetics preparation. The first and second regions 23, 24 of the portion 22 are positioned so that the two respective colours of these regions 23, 24 are similarly represented on the skin of the eyelid. While a simple arrangement of only two regions 23, 24 is depicted in FIG. 1, intended to apply different colours respectively to the upper and lower portions of the eyelid, a wide variety of different colours, or of graded colour tones, of cosmetics preparation can be applied to the surface 21 of the applicator 20.

The "teardrop" shape of the surface 21 shown in FIG. 3 is particularly suited for use of the cosmetics applicator 20 for applying cosmetic colouring, eg. eyeshadow, to the eyelids. As the clear portion 25 of the surface 21 is not covered with cosmetics preparation, it can be gripped between the thumb and forefinger. With the applicator 20 being held in this way, the index finger can be used to apply pressure to the back of the applicator 20 (which is, of course, disposed opposite the surface 21 and not covered with cosmetics preparation) so that most of the cosmetics preparation, together with the underlay, on the covered portion 22 of the applicator 20 rubs off onto, ie. is transferred to, the skin of the eyelid in a single wiping pass or swipe of the cosmetics preparation across the skin surface. The actual proportion of eyeshadow transferred will typically depend on the actual finger pressure applied to the applicator as it is wiped across the eyelid. The original underlay forms an outer protective and/or seal coating that assists in stabilising and maintaining the eyeshadow over subsequent hours.

The transfer efficiency of this wiping action is facilitated by the generally curved edges of applicator 20, by the elongated shape of the applicator, and by portion 22 being of a length and width to generally match an eyelid.

The surface 21 is of a PTFE-containing material having a low coefficient of friction, selected to facilitate retention of the cosmetics preparation and underlay thereon, preferably at least in part by electrostatic attraction, while allowing the major proportion of the cosmetics preparation retained thereon to be transferred to a human skin surface in a single wiping pass or swipe of the cosmetics preparation across the skin surface. The cosmetics preparation thus readily wipes off the surface 21 and onto the skin. The material should thus preferably be suitable both for being electrostatically charged at its surface and for having friction properties such that the cosmetics preparation, and preferably also the underlay, easily transfer by wiping action to the skin.

A suitable PTFE-containing material for applicators 20 is FL100 Virgin PTFE supplied by Dotmar EPP, preferably of thickness 4 to 5 thousandths of an inch (about 0.100 to 0.125 mm), having a static co-efficient of friction at 0.23 MPa of 0.04 and a dynamic co-efficient of friction at 0.23 MPa, 0.75 m/sec of 0.05. The specific gravity is 2.16, tensile strength 30.0 MPa, flexural modulus 690 MPa, and compressive strength under 5% strain 12.1. Shore D Hardness is in the range 5065.

Other PTFE-containing materials that can be suitable include PTFE-impregnated or coated paper or fibre, eg. glass fibre, mesh, or PTFE-coated plastics substrates.

Electrostatic attraction between the cosmetics preparation and the surface 21, at least partly assists in retaining the cosmetics preparation to the surface 21 prior to it being wiped off. The waxy or oily underlay further assists in this retention.

There is typically no outer protection film but such can be included if necessary for additional protection of the cosmetic.

The principal dimensions of applicator 20 are, with reference to FIG. 1, about 60 to 75 mm for x and about 15 to 25 mm for y. Thus, the applicator is elongate with a length to width ratio in the region of 3 to 4.

Figure 2:
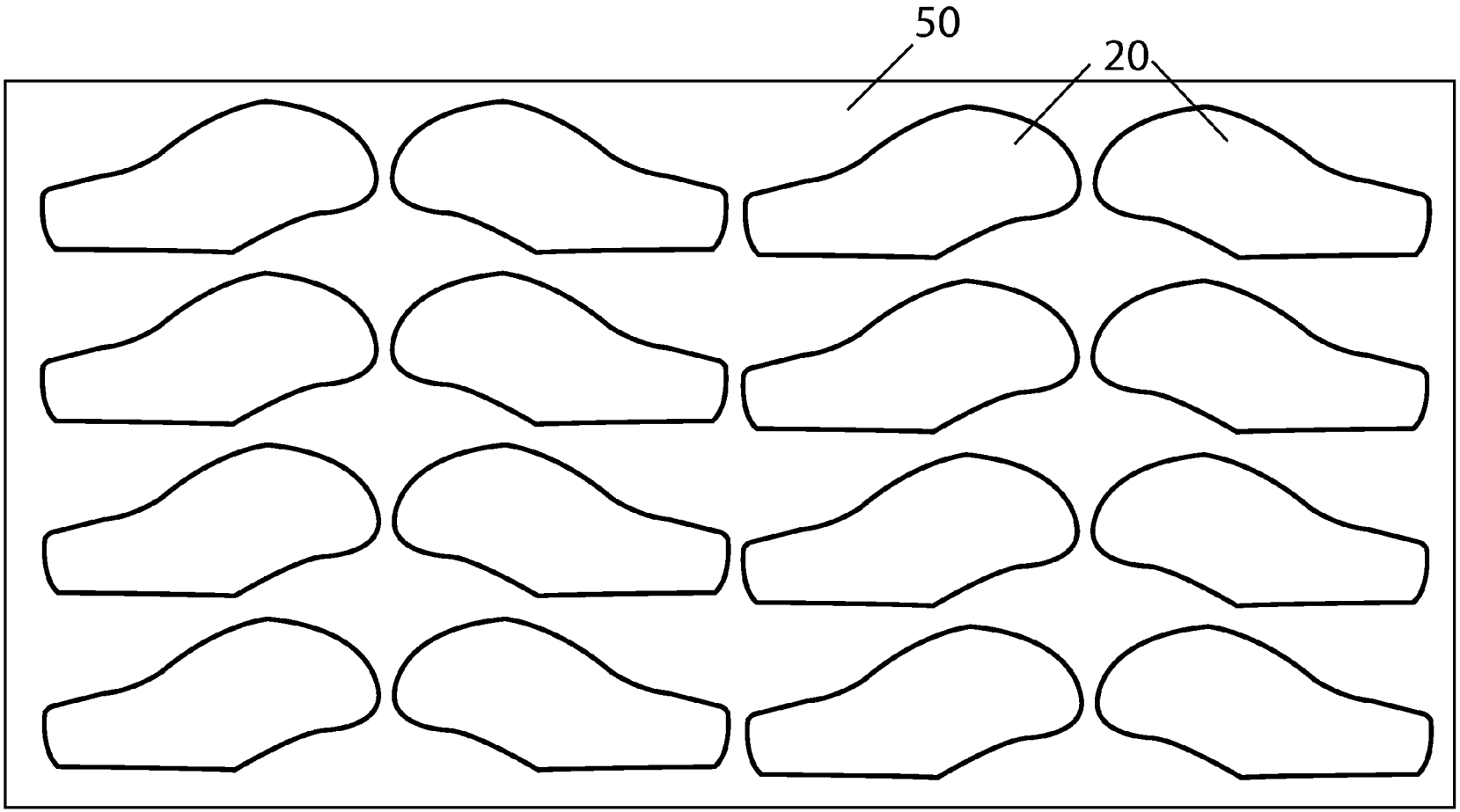
FIG. 2 is a representation of a plurality of shaped cosmetic applicators produced by apparatus and method for manufacture according to an embodiment of the invention.
Figure 6:
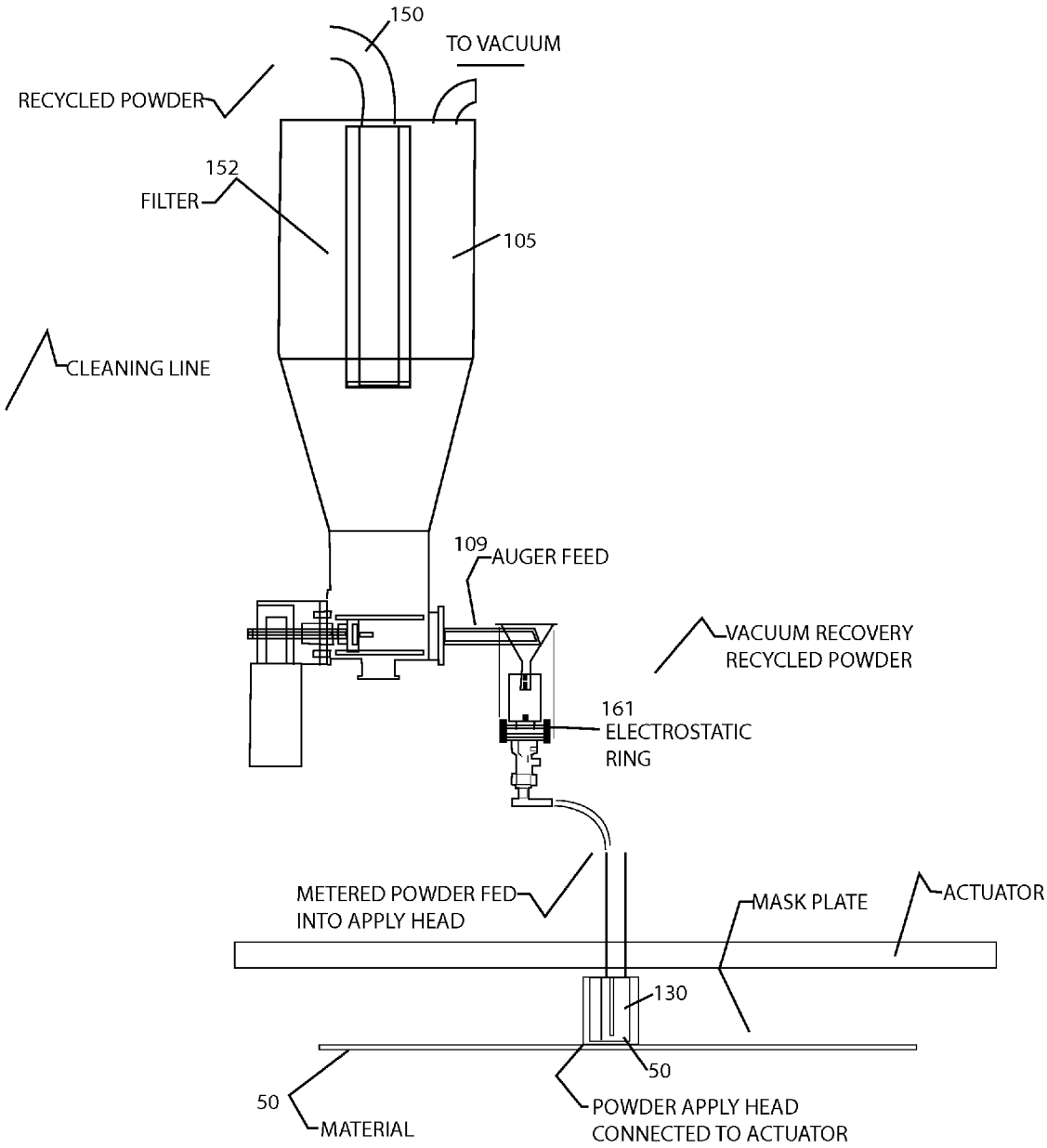
FIG. 6 is a cross-sectional diagrammatic representation of a particularly preferred application facility used to manufacture cosmetic applicators of the kind depicted in FIG. 1 including an excess powder recovery system and an electrostatic control system.
Figure 7A:
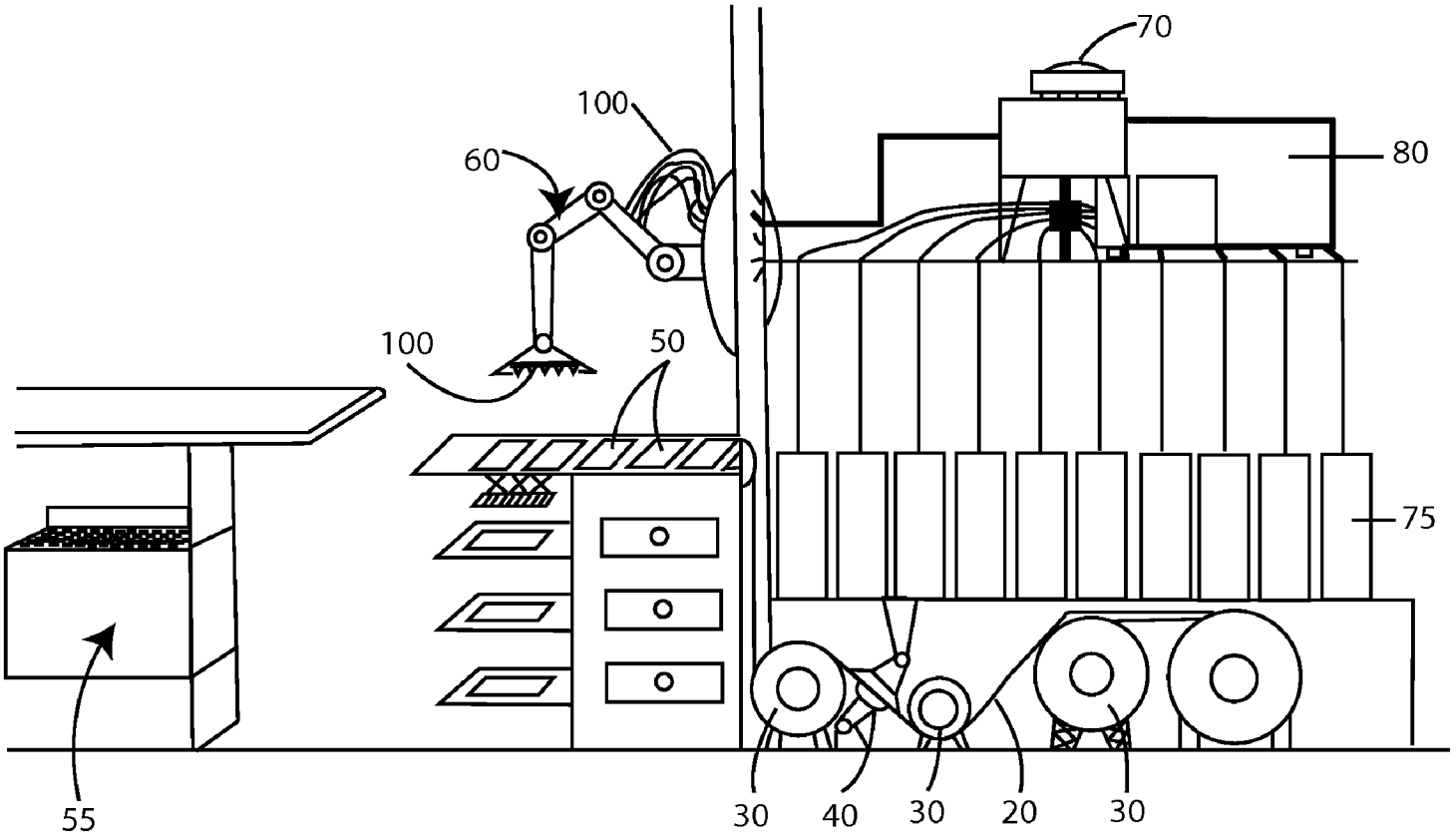
FIGS. 7A and 7B are schematic representations of a production facility used to manufacture cosmetic applicators of the kind depicted in FIG. 1.
Figure 7B:
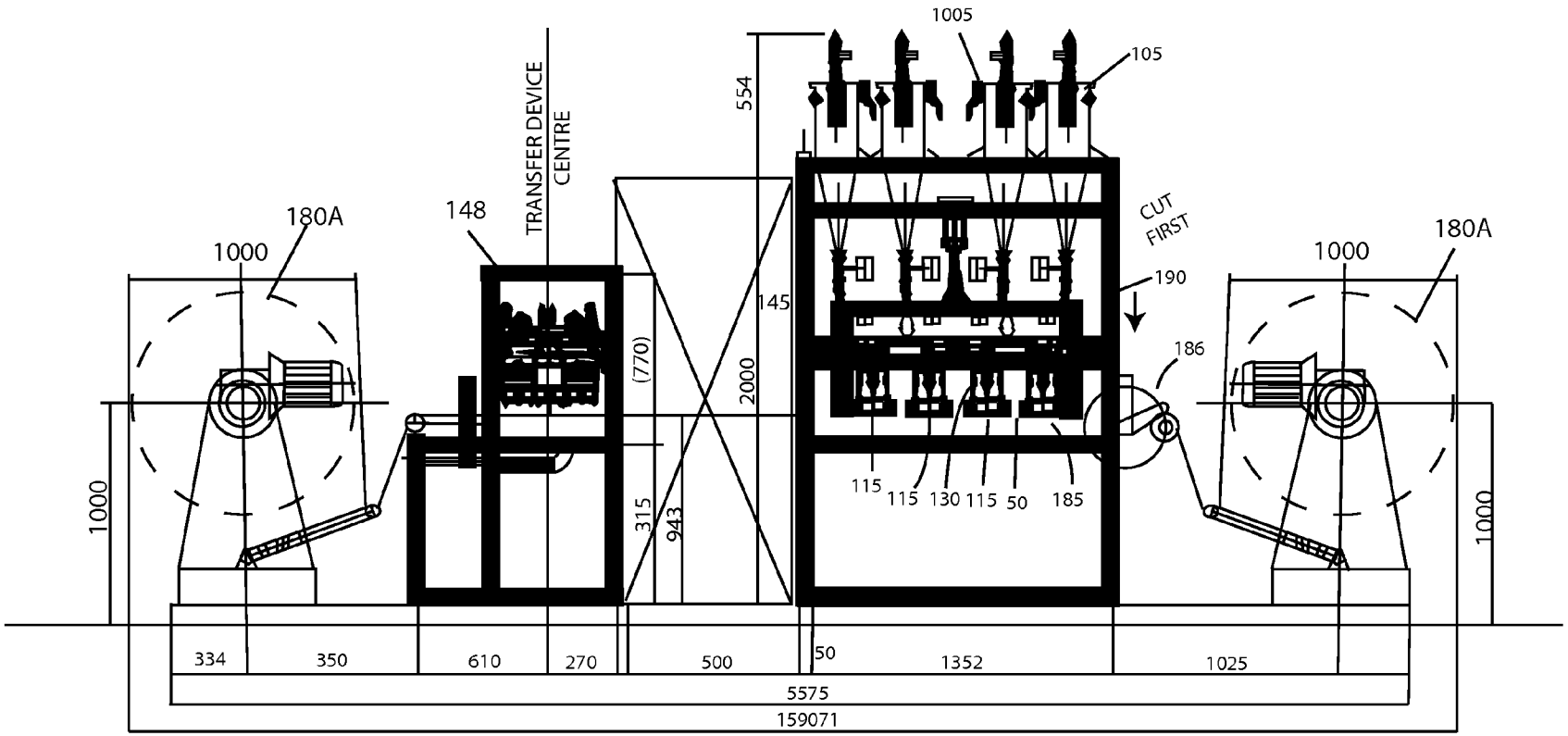

Manufacture of the cosmetics applicators is achieved using an overall production facility 10 is schematically represented in two FIGS. 7A and 7B. A sheet of cosmetics applicators 20 that are produced using this facility 10 are represented in FIG. 2. An enlarged presentation of a cosmetic applicator is provided by FIG. 1. However a significant fundamental part of the production facility is shown in various forms in FIGS. 3*a*, 3*b*, 4, 5 and 6.

Referring particularly to various forms of significant fundamental part of the production facility shown in FIGS. 3*a*, 3*b*, 4, 5 and 6 there is shown various forms of an individual cosmetic application system that can be used in the production facility of cosmetic applicators.

Figure 3A:
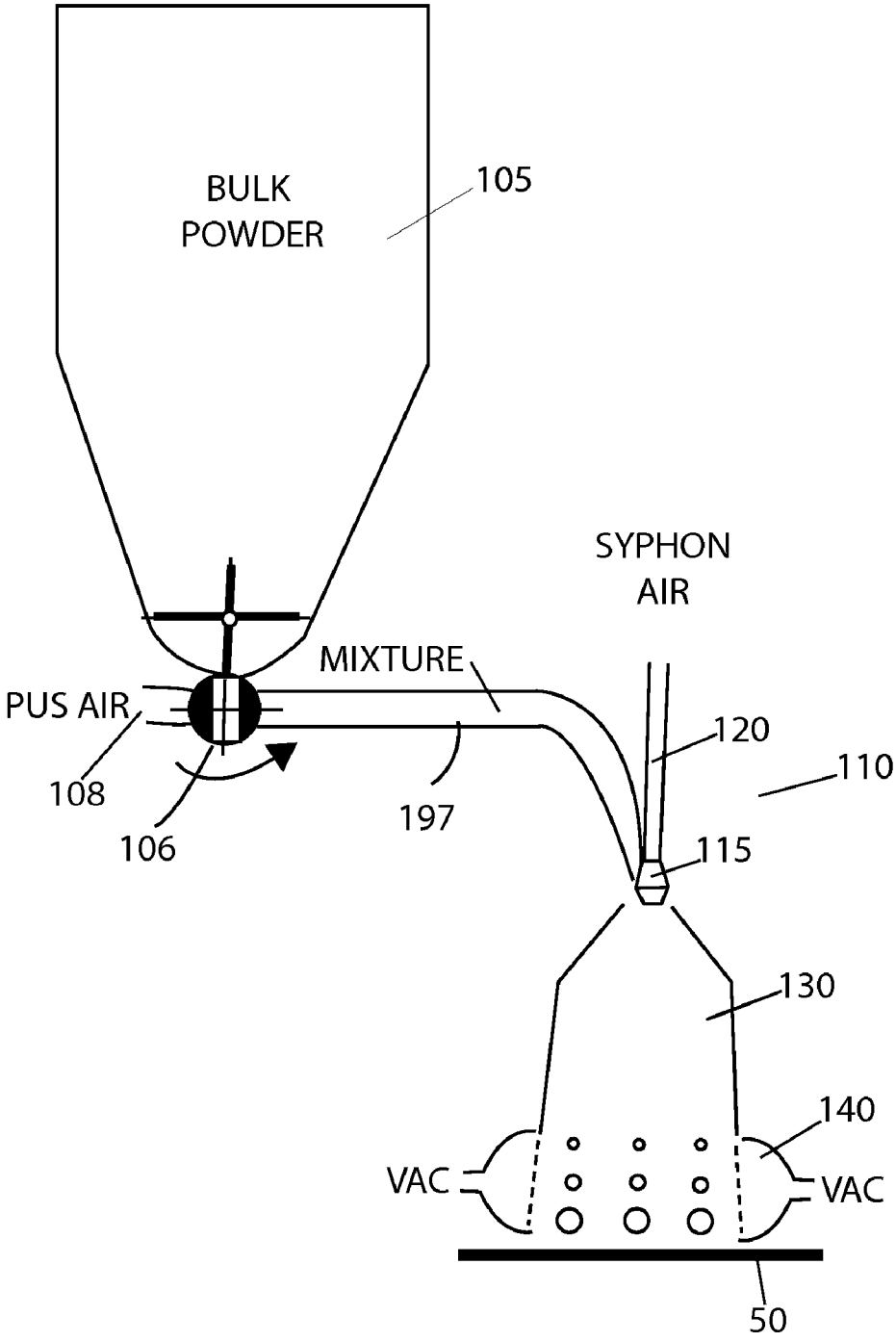
FIG. 3*a* and FIG. 3*b* are schematic representations of a fundamental part of a production facility used to manufacture cosmetic applicators of the kind depicted in FIG. 1 comprising an cosmetic application system for applying cosmetics to an applicator structure.
Figure 3B:
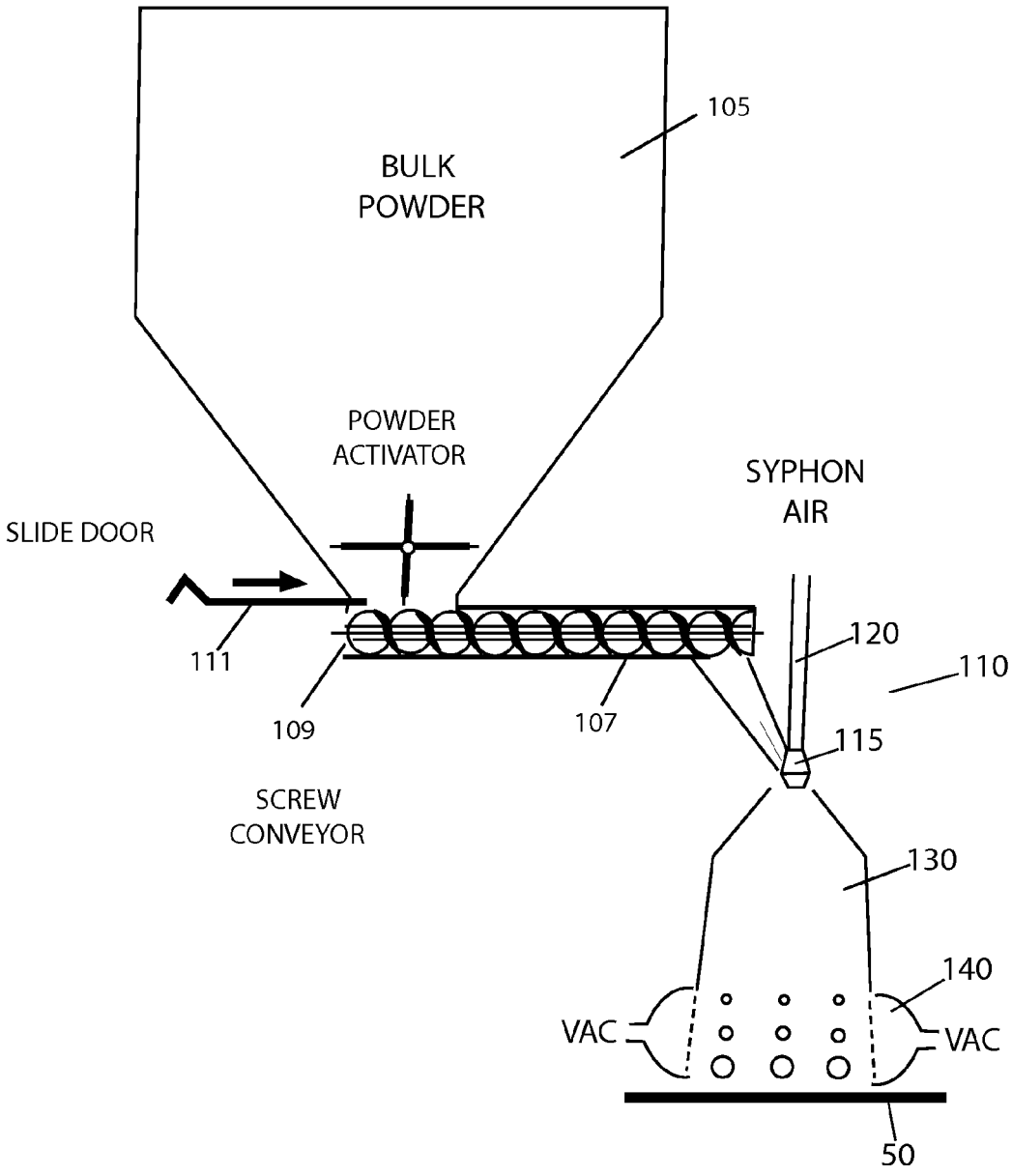
Figures 3A, 4:
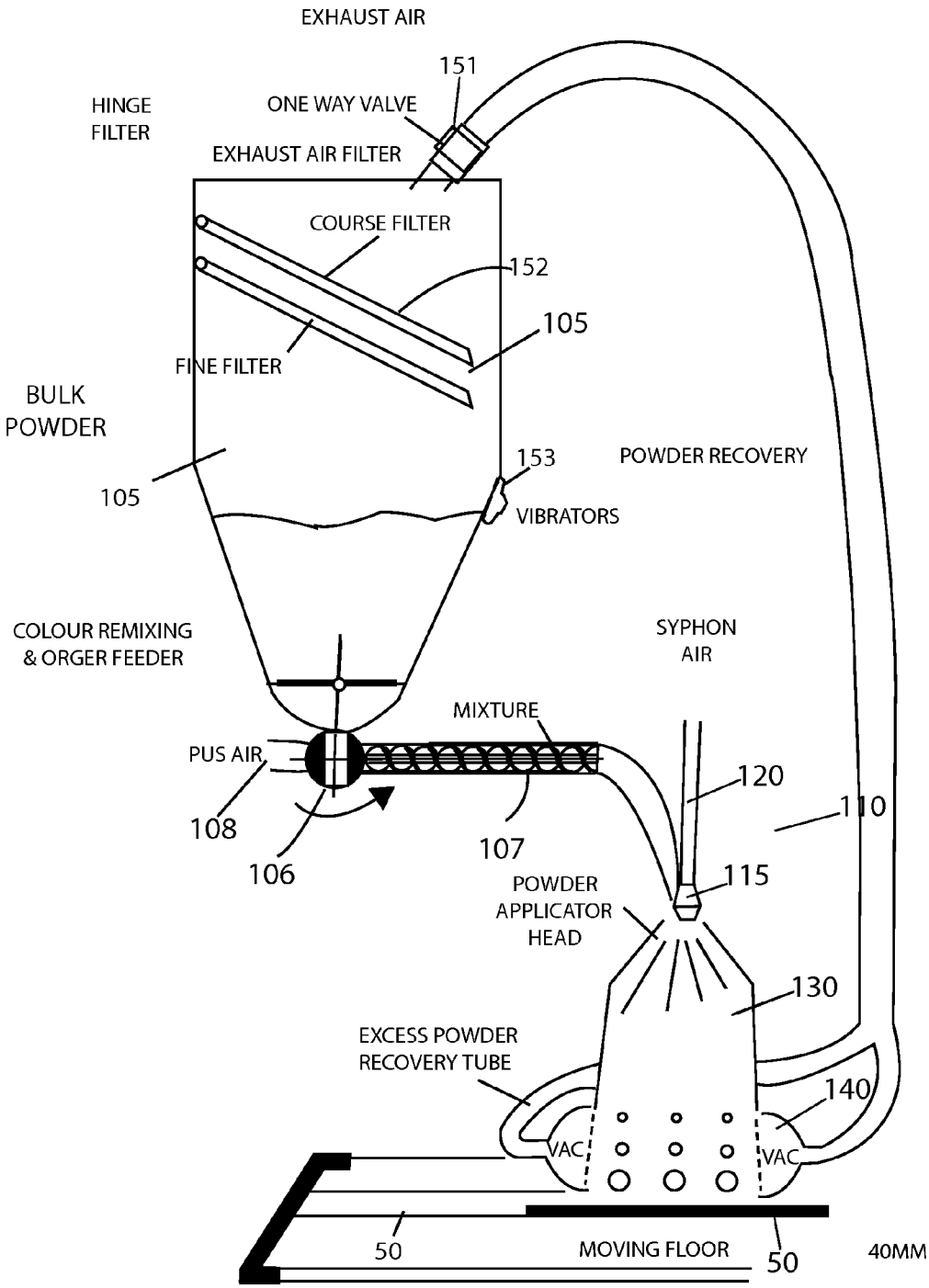
FIG. 4 is a schematic representation of an application facility used to manufacture cosmetic applicators of the kind depicted in FIG. 1 including an excess powder recovery system.

Each of these forms include a structure to provide a method of manufacturing a plurality of cosmetic applicators each of which includes a material surface and a cosmetics preparation provided on said surface. The system has a bulk powder storage vessel 105, an applicator 110 having at least one powder applicator head 115 for blowing cosmetic powder in a controlled manner. A feed means 107 extends from the bulk powder storage vessel 105 to the applicator 110 for providing powder to the applicator head 115 and a transport means such as positive air flow 108 along feed means 107 as shown in FIG. 3A or an auger 109 within feed means 107 as shown in FIG. 3B or 4. This transport means further includes syphon air (also known as venturi feed) for creating an air flow that drags the cosmetic material from the feed means 107 and transports the cosmetic material to the powder applicator head 115 to enable application of the powder in a controlled manner onto the material surface 50 wherein said cosmetics preparation is retained on said surface.

As shown in FIG. 4 there is a powder recovery means 150 comprising a shroud 130 having a first opening for receiving the powder applicator head 115 and a second larger opening enabling substantially close overfitting over the material surface 50 to which the powder is to be applied. The shroud 130 includes a third opening for connection to a vacuum system 140 for substantial recovery of unrequired material. The vacuum system 140 is connected to the bulk powder storage vessel 105 enabling reuse of excess powder. The bulk powder storage vessel 105 also includes a filtering system 152 for filtering and sifting powder entering the bulk powder storage vessel 105 to ensure consistent granular sizing.

Figure 5:
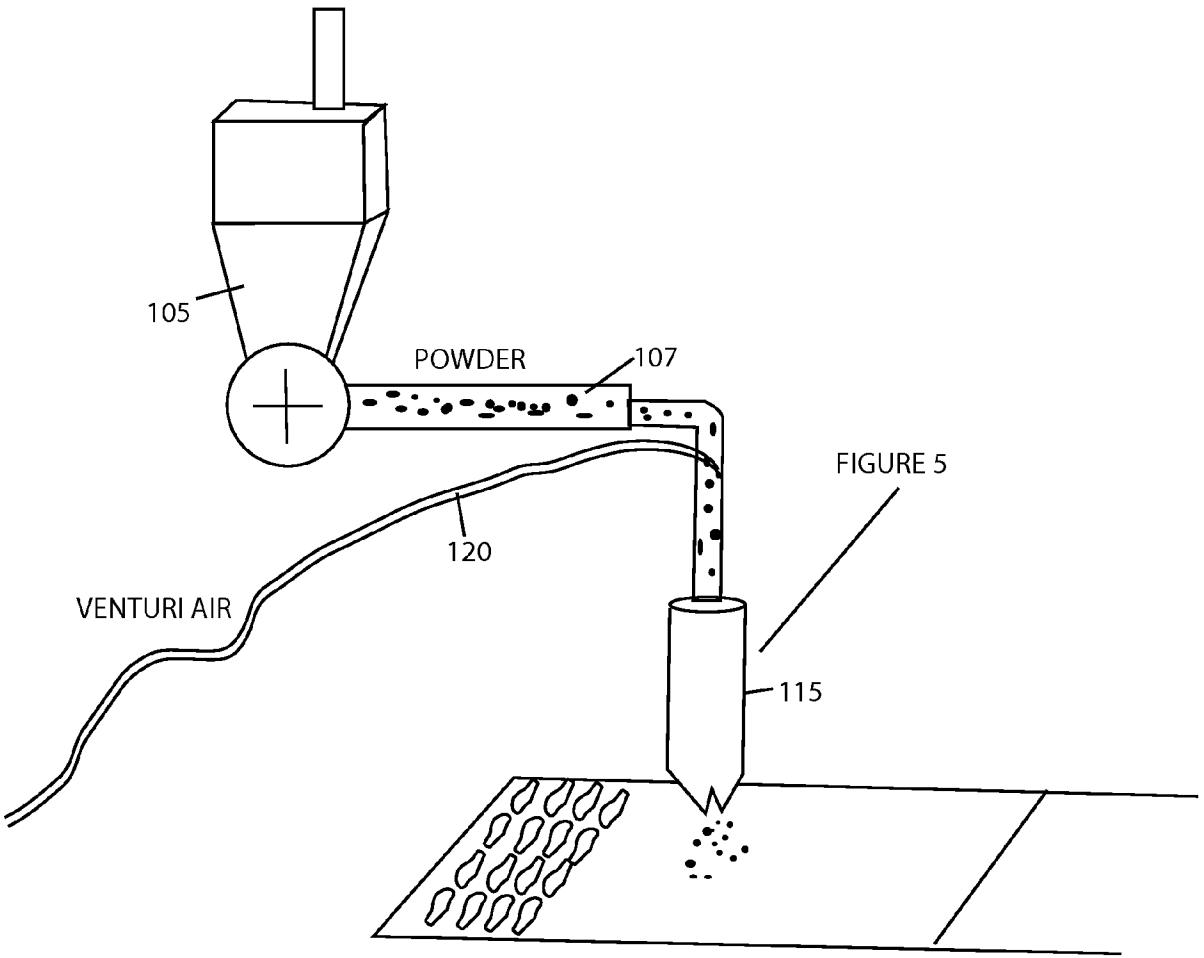
FIG. 5 is a schematic representation of an applicator head for use in the application facility used to manufacture cosmetic applicators of the kind depicted in FIG. 1.

As shown in FIG. 5 the powder applicator head 115 has a rectangular slit opening for simultaneous controlled spraying of a line of cosmetic applicators on the sheet of material 50.

As shown in FIG. 6 there is included an electrostatic control means including an electrostatic ring 161 in the feed to the applicator for dissipating electrostatic charge or localising electrostatic charge wherein the powder at least in part is retained on the cosmetic applicator surface with the assistance of electrostatic attraction between said surface and said cosmetics preparation.

Further the electrostatics is controlled by using ionised air on the cosmetic material as it is being blown onto the surface of the cosmetic applicator.

In the production facility of FIG. 7A the surface 21 is cut from a sheet of the PTFE-containing material, and electrostatic attraction between the surface 21 and the cosmetics preparation assists in attracting the preparation to, and retaining it on, the portion 22 of the surface 21.

The cosmetics applicator 20 can be manufactured by means of the production facility illustrated schematically in FIG. 7A. A roll of sheet comprising the selected PTFE-containing material is spooled, using rolls 30, between opposed friction plates 40 that develop an electrostatic charge on the material 20 as the material 20 runs between the plates 40. The sheet 20 is cut into individual rectangular sheets 50, which are fed along a conveyor line towards a robotic applicator 60. A stencil, which has holes for the covered portions 22 of each of the applicators 20 placed on a given sheet 50, is placed over each sheet.

The robotic applicator 60 is used to apply the waxy or oily underlay and then the cosmetics preparation onto each sheet 50. The cosmetics preparation, a coloured powder material, is supplied to a mixing vat 70 for colour tanks 75, and mixed with air from an air tank 80. Various colours of aerated powder of the cosmetics preparation are supplied to the robotic applicator 60 though powder lines 100. The air nozzles 110 deliver the actual aerated power to the stencil covered sheets 50 after application of the waxy or oily underlay. A computer control programme in controller 55 is used to control the actions of the robotic applicator 60 to ensure appropriate delivery of the aerated powder to the sheets 50.

Figure 8:
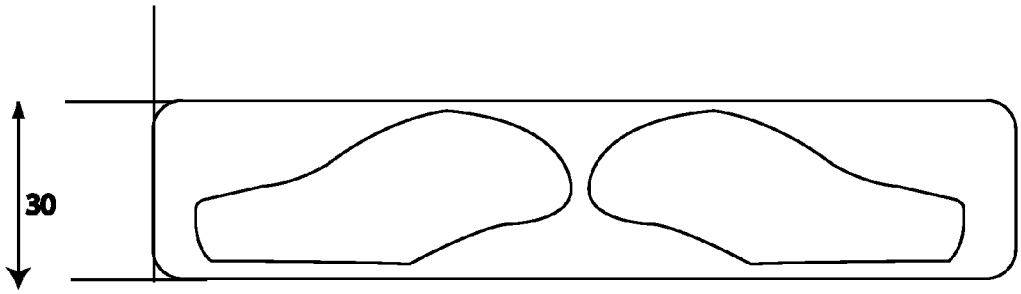
FIG. 8 is a resultant pair of packaged cosmetics applicators for use.

After the cosmetics preparation has been applied to the stencil-covered sheets 50, the stencil can be removed, and a guillotine press used to stamp out individual applicators 20 according to the pattern shown in FIG. 8. Each block 205 of applicators 20 depicted in FIG. 8 can be supplied in a convenient package as required, for example laid out in a moulded tray 310 for easy grasping and use.

The package thus forms a cosmetics application kit comprising an array of applicators 20 in a manually accessible receptacle. It will be seen that the applicators are stamped out in complementary pairs 207 of "left" and "right" applicators 208,209, i.e. the applicators are handed to facilitate application of the preparation to the left or right eye respectively.

In an alternative approach, instead of or in addition to application of the waxy or oily underlay, the surface of sheet 20 is prepared by being wiped with a suitable alcohol.

In the production facility of FIG. 7B a roll of film 180 comprising a foam backing and a PTFE surface material is provided and fed onto a transport means below a plurality of powder applicator heads 115 each connected to a respective bulk powder storage vessel 105. After being spooled from the roll of film 180 the sheet is vacuum held on the transport means 185 and cut into the relative shapes 20 such as the continuous sheet 50 of plurality of pairs of cosmetic applicators shown in FIG. 2. These cut-outs 20 are retained in skeleton form within the sheet 50 as it passes under the plurality of powder applicator heads 115.

However initially in the method of application of the cosmetics powder there is an initial applicator 190 for applying a moisturising solution to the cosmetic powder or the surface material of the cosmetic applicator 20 wherein the moisturising solution allows bonding of various powders applied thereon. The individual coloured powders from each of the plurality of powder applicator heads 115 then applies coloured powder at required positions on the surface material of the plurality of cosmetic applicators.

A final step in the application of cosmetic powder is by applicator 195 for applying a protection solution to the applied cosmetic powder on the surface material of the cosmetic applicator 20. Since the protection solution is the last layer on the cosmetic applicator, it becomes the first layer when used wherein the protection solution is applied directly to the user's skin with the cosmetic powder thereover.

This plurality of cosmetic applicators is then fed by the transfer device 198 to a packaging apparatus while the skeleton of sheet with holes from the plurality of removed cosmetic applicators 20 is rolled back onto a disposal roll 180A.

It is found that the use of a pair of cosmetic applicators formed by the invention to apply eyeshadow achieves very good balance between the two sides of the face and eyes, giving the user a high level of confidence in her appearance. The physical size of the required package for a set of the applicators is relatively compact and convenient. The applicators facilitate self-applications of eye makeup within seconds rather than the 10 or 15 minutes presently required.

It should be understood that the above description is of preferred embodiments of the invention and included as illustration only. It is not limiting of the invention. Clearly variations of the apparatus and method for manufacture of cosmetic applicators would be understood by a person skilled in the art without any inventiveness and such variations are included within the scope of this invention as defined in the following claims.

Claims defining the invention are as follows:

1. A method of manufacturing, using an apparatus, a plurality of cosmetic applicators each of which includes a material surface and cosmetic preparation which is carried by the material surface and which includes at least one cosmetic powder layer; the method comprising the steps of:

providing the apparatus comprising:

at least one bulk powder storage vessel to house a cosmetic powder;

at least one applicator having at least one powder application head;

a feed means from the at least one bulk power storage vessel to at least one of the at least one applicator for providing a portion of the cosmetic powder to the applicator;

a transport means which transports the material surface relative to the powder applicator head to enable application of the cosmetic powder in a controlled manner onto the material surface in the form of a pattern while allowing the cosmetic preparation retined thereon to be transferred onto a human skin in a single wiping pass of the substantially powder cosmetic preparation across the skin surface; and an electrostatic control means;

generating an electrical charge on the material surface;

removing electrostatic charge from the cosmetics powder using the electrostatic control means;

wherein the powder at least in part is retained on the cosmetic applicator material surface with the assistance of electrostatic attraction between said surface and said cosmetic preparation;

controlling the electrostatics using ionised air, during the application of the cosmetic powder on said surface using the powder applicator head, on the cosmetic powder as the ionised air is blown onto the surface of the cosmetic applicator to form a predetermined pattern on the cosmetic applicator.

2. The method of manufacturing a plurality of cosmetic applicators according to claim 1 wherein the mixing of the ionized air with the de-ionized cosmetics powder is achieved by using a venturi system to receive the cosmetic powder from the bulk powder storage vessel into a controlled air flow for applying the cosmetic powder onto the cosmetic applicator surface material.

3. The method of manufacturing a plurality of cosmetic applicators according to claim 1 which includes the step of recovering using a recovery means to recover un-required cosmetic powder by placing a shroud having a first opening for receiving the powder applicator head and a second larger opening enabling substantially close over-fitting of the shroud over the material surface and drawings un-required cosmetic powder from the shroud through a third opening for processing with a vacuum system for substantial recovery of un-required material.

4. The method of manufacturing a plurality of cosmetic applicators according to claim 3 which includes the further step of transferring cosmetic powder processed with the vacuum system to the bulk powder storage vessel enabling reuse of the un-required powder.

5. The method of manufacturing a plurality of cosmetic applicators according to claim 1 wherein the apparatus further includes a plurality of bulk powder storage vessels each of which including a different coloured cosmetic powder and connected to and able to feed to at least one powder applicator head for blowing powder in a controlled manner; the method further including the steps of:

placing a stencil on the material surface to confine attraction of the cosmetic powder to one or more predetermined areas on the material surface; and blowing in a controlled manner a mixture of ionized air with different coloured cosmetic powders on the material surface thereby to cause attraction of a respective cosmetic powder to a required region on the material surface to cause the cosmetic preparation to include different coloured cosmetic preparations.

6. The method of manufacturing a plurality of cosmetic applicators according to claim 1 which includes the step of vibrating at least one bulk powder storage vessel using a vibration means to maintain the cosmetic powder in a granular form.

7. The method of manufacturing a plurality of cosmetic applicators according to claim 1 including the steps of:

applying a waxy or oily underlay to the material surface before applying the cosmetic powder to the material surface thereby to facilitate retention of the cosmetic powder to the material surface thereby to facilitate retention of the cosmetic powder on the material surface; and applying a protection or moisturising solution to the cosmetic powder on the surface material of the cosmetic applicator to bond the cosmetic powder on the material surface.

8. The method of manufacturing a plurality of cosmetic applicators according to claim 7 wherein said waxy or oily underlay is cosmetic foundation.

9. The method of manufacturing a plurality of cosmetic applicators according to claim 1 which includes the step of passing the material surface in between opposed friction plates to develop an electrostatic charge on the material surface.

10. A method of manufacturing, using an apparatus, a plurality of cosmetic applicators each of which includes a material surface and a cosmetics powder provided on the material surface; the method comprising the steps of:

generating an electrical charge on the material surface;

removing electrostatic charge from the substantially powdered cosmetics preparation before being applied to the material surface;

mixing ionized air with the de-ionized substantially powdered cosmetics preparation; and blowing the mixture of ionized air and de-ionized cosmetics powder preparation onto the material surface thereby to cause electrostatic attraction of the cosmetics powder preparation to the material surface.

* * * * *